US006640892B1

(12) United States Patent
Wright

(10) Patent No.: US 6,640,892 B1
(45) Date of Patent: Nov. 4, 2003

(54) TUBING STRING ROTATOR

(75) Inventor: Andrew J. Wright, Leduc (CA)

(73) Assignee: Gadu, Inc. (BB)

( * ) Notice: Subject to any disclaimer, the term of this patent is extended or adjusted under 35 U.S.C. 154(b) by 0 days.

(21) Appl. No.: 10/158,891

(22) Filed: Jun. 3, 2002

(51) Int. Cl.[7] ..... E21B 43/00; E21B 33/04
(52) U.S. Cl. ..... 166/78.1; 166/68.5
(58) Field of Search ..... 166/379, 381, 166/78.1, 68.5; 417/424.1

(56) References Cited

U.S. PATENT DOCUMENTS

| | | | | |
|---|---|---|---|---|
| 2,471,198 A | | 5/1949 | Cormany | |
| 2,693,238 A | | 11/1954 | Baker | |
| 4,716,961 A | * | 1/1988 | Makins et al. | 166/68.5 |
| 5,139,090 A | | 8/1992 | Land | |
| 5,327,975 A | | 7/1994 | Land | |
| 5,383,519 A | | 1/1995 | Wright et al. | |
| 5,388,639 A | | 2/1995 | Betchan et al. | |
| 5,427,178 A | | 6/1995 | Bland | |
| 5,429,188 A | | 7/1995 | Cameron et al. | |
| 5,431,230 A | | 7/1995 | Land et al. | |
| 5,465,788 A | | 11/1995 | Wright | |
| 5,746,249 A | | 5/1998 | Wright et al. | |
| 5,964,286 A | | 10/1999 | Cuppen | |
| 6,026,898 A | | 2/2000 | Bland et al. | |
| 6,125,931 A | * | 10/2000 | Hult et al. | 166/68.5 |
| 6,199,630 B1 | | 3/2001 | Blundell et al. | |
| 6,543,533 B2 | * | 4/2003 | Meek et al. | 166/78.1 |
| 2003/0024709 A1 | * | 2/2003 | Cuppen | 166/382 |

FOREIGN PATENT DOCUMENTS

| | | |
|---|---|---|
| CA | 2278059 | 1/2001 |
| JP | 363251520 A | 10/1988 |

* cited by examiner

*Primary Examiner*—Hoang Dang
(74) *Attorney, Agent, or Firm*—Merek, Blackmon & Voorhees

(57) ABSTRACT

A tubing string rotator is disclosed that comprises an outer housing, a gear mandrel, and a tubing string hanger. The outer housing has an internal bore extending from its upper to its lower. The gear mandrel is received and supported within the bore of the outer housing. The gear mandrel has an internal bore extending from its upper to its lower end. The tubing string hanger has a series of circumferentially positioned generally downwardly oriented teeth and is receivable and suspendable within the internal bore of the gear mandrel such that the teeth on the tubing string hanger engage a series of generally upwardly oriented teeth circumferentially positioned about the internal surface of the gear mandrel. Rotational force applied to the gear mandrel is at least partially transferred to the tubing string hanger through engagement of the teeth on the gear mandrel with the teeth on the hanger causing the tubing string hanger to rotate with the gear mandrel.

18 Claims, 6 Drawing Sheets

TUBING STRING ROTATOR

FIELD OF THE INVENTION

This invention relates to a tubing string rotator, and in one particular embodiment a rotator that may be attached to a wellhead and used to suspend and rotate a tubing string within a wellbore.

BACKGROUND OF THE INVENTION

Fluids that are pumped from wellbores utilizing a downhole pump are typically transported to the surface through the use of a tubing string. It is well known that to minimize wear on the surface of the tubing string through contact with the pump rod, and to extend the useful life of the string, a tubing string rotator may be used to slowly rotate the string within the well casing and to more evenly distribute wear about the surface of the string.

Tubing string rotators that have been developed and put into practice to date have a wide variety of different configurations and structures. In most instances the rotator acts as both a hanger to suspend the string within the well casing, and as a means to impart rotational movement to the tubing string. In order to cause the string to revolve within the casing, rotators commonly utilize a mechanical linkage connecting a series of gears or a drive system to a tubing string hanger. The mechanical connection between the drive system and the hanger is often in the form of either a key or a series of interlocking splines. Unfortunately, when using a keyed or splined connection alignment between adjacent parts is critical. In the case a keyed connection misalignment will prevent insertion of the key. When a splined connection is used misalignment could potentially result in damage to the splines or may cause the hanger and string to become jammed within the rotator. In addition, where the fluids that are being extracted from the well contain a high degree of sand or particulate matter, debris can often find its way into small spaces between the splines or adjacent to the key. Sand or other particulate material that becomes lodged within these areas can cause the entire structure to lock together. In such cases it can become extremely difficult (if not virtually impossible) to remove the hanger from the rotator.

SUMMARY OF THE INVENTION

The invention therefore provides a tubing string rotator that facilitates the insertion and removal of a tubing string hanger from the rotator. The invention allows for the rapid insertion and removal of the tubing string hanger, while at the same time eliminating the risk and the potential damage that may be caused by misalignment of the hanger with the internal drive system of the rotator. In addition, the invention provides a tubing string rotator that helps to facilitate the removal of a tubing string hanger in situations where well fluids contain a high degree of sand and other particulate material.

Accordingly, in one of its aspects the invention provides tubing string rotator comprising; an outer housing having an upper end and a lower end with an internal bore extending therethrough from said upper to said lower end; a gear mandrel receivable and supportable within said internal bore of said outer housing, said gear mandrel having an upper end and a lower end and an internal surface that defines an internal bore extending through said gear mandrel from said upper to said lower end; and, a tubing string hanger having an upper end, a lower end and an external surface, said external surface of said tubing string hanger having a series of circumferentially positioned generally downwardly oriented teeth, said tubing string hanger receivable and suspendable within said internal bore extending through said gear mandrel such that said teeth on said tubing string hanger engage a series of generally upwardly oriented teeth circumferentially positioned about said internal surface of said gear mandrel whereby rotational force applied to said gear mandrel is at least partially transferred to said tubing string hanger through engagement of said generally upwardly and said generally downwardly oriented teeth causing said tubing string hanger to rotate with said gear mandrel.

In a further aspect the invention provides tubing string rotator comprising; an outer housing having a generally hollow interior and having an internal bore extending through said housing from an upper end to a lower end of said housing; a gear mandrel receivable within said hollow interior of said outer housing, said gear mandrel having an upper end and a lower end and an internal surface that defines an internal bore extending through said gear mandrel from said upper to said lower end; a drive gear engaging said gear mandrel such that rotation of said drive gear causes rotation of said gear mandrel about an axis generally parallel to said internal bore extending through said gear mandrel; and, a tubing string hanger receivable and suspendable within said internal bore of said gear mandrel, said tubing string hanger having an external surface having mounted thereon a plurality of circumferentially positioned generally downwardly oriented teeth, said generally downwardly oriented teeth engaging a plurality of compatibly shaped generally upwardly oriented teeth circumferentially positioned about said internal surface of said gear mandrel when said tubing string hanger is received without said gear mandrel such that said tubing string hanger may be rotated through the transference of rotational force applied to said gear mandrel to said tubing string hanger through engagement of said generally upwardly and said generally downwardly oriented teeth.

In yet a further aspect the invention concerns a tubing string rotator comprising; an outer housing having an upper end and a lower end, said lower end adapted to be received upon an oil well casing or wellhead, said outer housing having an internal bore extending therethrough from said upper end to said lower end; a gear mandrel received and supported within said internal bore of said outer housing, said gear mandrel having an internal surface that defines an internal bore extending therethrough, said internal surface of said gear mandrel including a reduced diameter portion having circumferentially positioned thereabout a plurality of generally upwardly oriented teeth; and, a tubing string hanger receivable and suspendable within said internal bore through said gear mandrel, said tubing string hanger having an exterior surface containing a plurality of circumferentially positioned generally downwardly oriented teeth engagable with said generally upwardly oriented teeth of said gear mandrel when said tubing string hanger is received within said internal bore in said gear mandrel such that rotational force applied to said gear mandrel is at least partially transferred to said tubing string hanger through engagement of said generally upwardly and said generally downwardly oriented teeth causing said tubing string hanger to rotate with said gear mandrel, and wherein at least a portion of the weight of said tubing string hanger is transmitted to and borne by said gear mandrel through engagement of said generally upwardly and said generally downwardly oriented teeth.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

Figure 1:
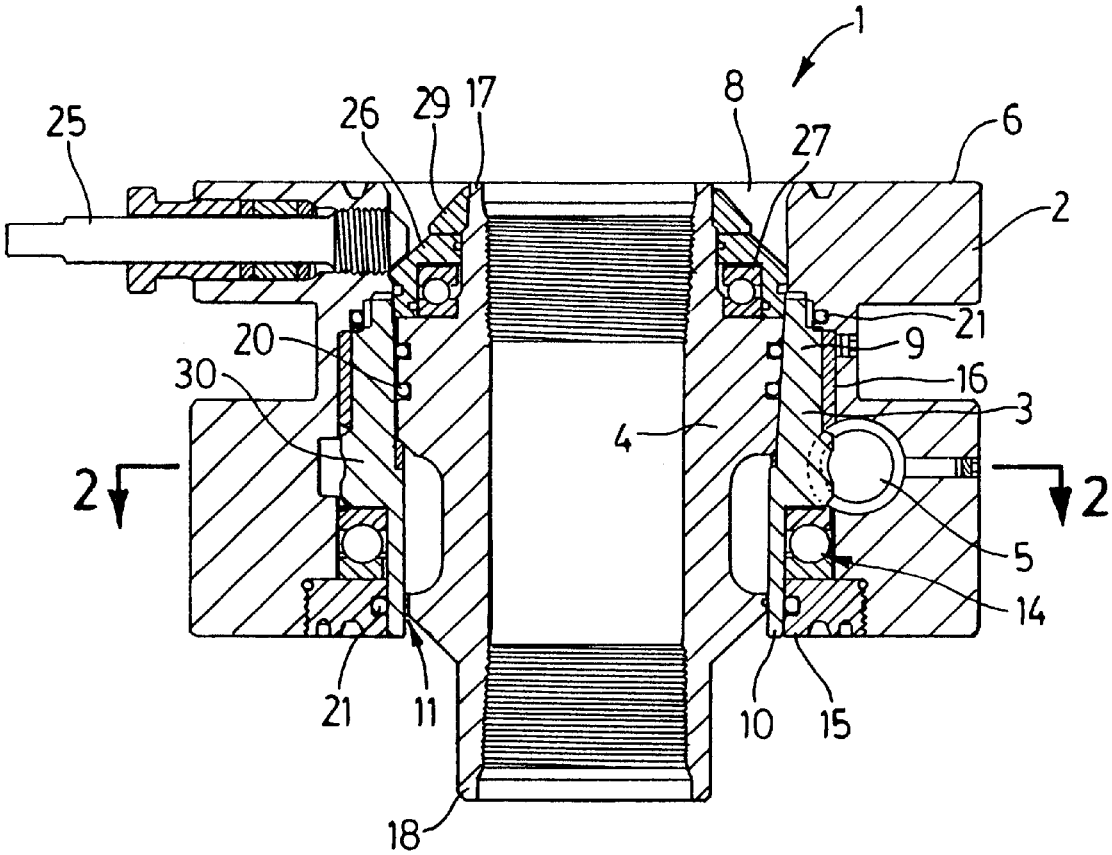
FIG. 1 is a side sectional view of a preferred embodiment of the tubing string hanger according to the present invention.
Figure 2:
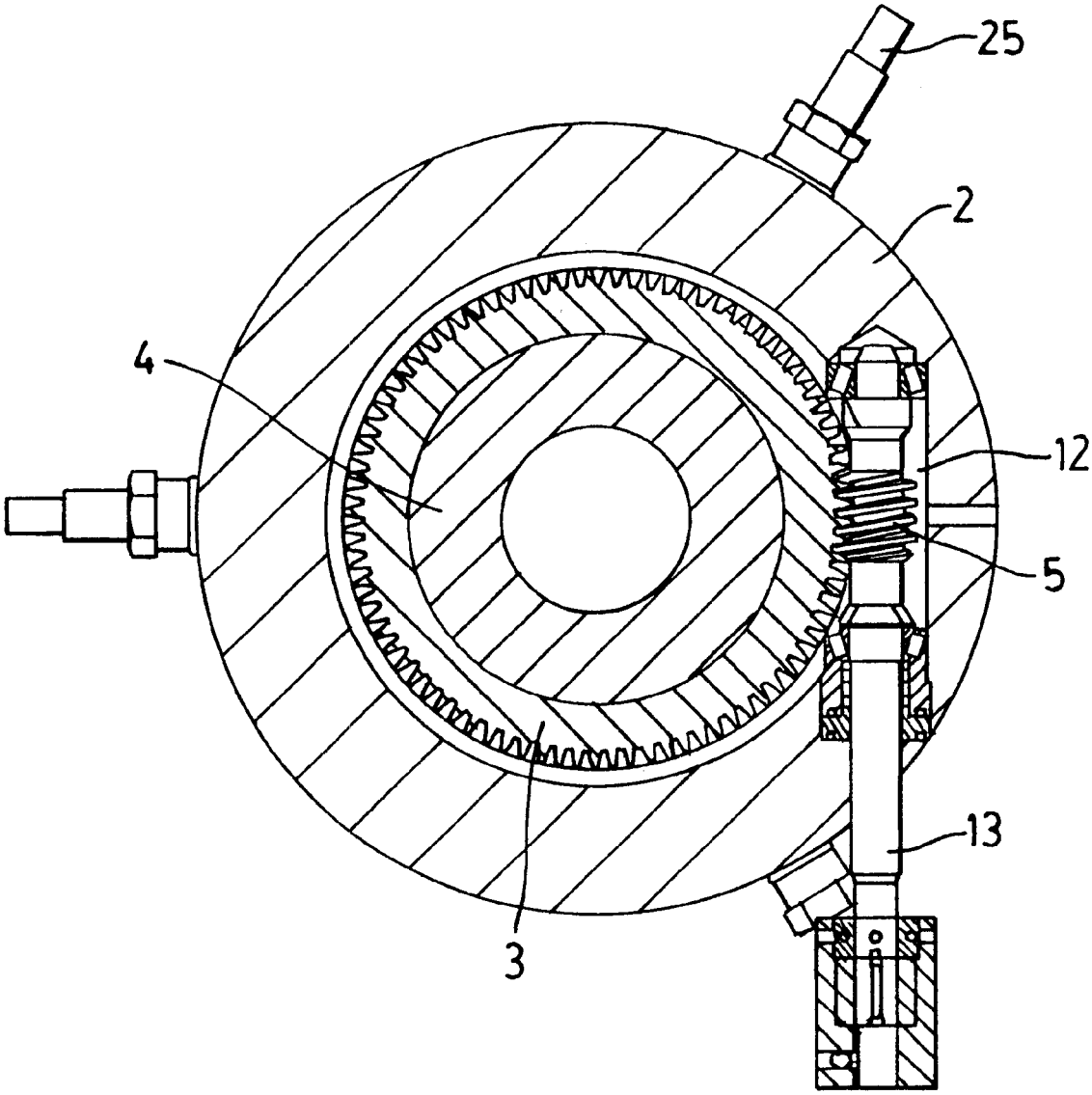
FIG. 2 is a horizontal sectional view taken on the line 2—2 of FIG. 1.

The present invention may be embodied in a number of different forms. However, the specification and drawings that follow describe and disclose only some of the specific forms of the invention and are not intended to limit the scope of the invention as defined in the claims that follow herein.

In the attached Figures the tubing string rotor in accordance with a preferred embodiment of the present invention is noted generally by reference numeral 1. The primary components of tubing string rotator 1 include an outer housing or shell 2, a gear mandrel 3, a tubing string hanger 4, and a drive gear 5. As shown generally in FIG. 1, outer housing 2 has an upper end 6, a lower end 7 and an internal bore 8 extending from its upper to its lower end. Upper and lower ends 6 and 7 of housing 2 may be flanged or studded, as necessary for any particular application to allow the housing to be fastened to the well casing and to other wellhead components.

In the embodiment of the invention shown in the attached drawings, gear mandrel 3 is generally cylindrical in shape and is received and supported within bore 8 that extends through outer housing 2. Gear mandrel 3 has an upper end 9, a lower end 10, and an internal bore 11 that extends from its upper to its lower end. A circumferential bull gear 30 extends around the exterior of gear mandrel 3 and engages drive gear 5. In the embodiment shown, drive gear 5 is a worm gear received within a generally horizontally oriented bore 12 extending into outer housing 2. In this fashion, a drive system can be attached to the outer end 13 of worm or drive gear 5 such that rotation of the drive gear causes a corresponding rotation of gear mandrel 3 about an axis generally parallel to bore 11 extending therethrough.

When received within bore 8, gear mandrel 3 is effectively hung from a lower thrust bearing 14 that is situated within bore 8 and held in place by a bottom or retaining nut 15 threaded into lower end 7 of outer housing 2. The weight of gear mandrel 3 and any load that is transmitted to it is thereby borne by lower thrust bearing 14 and transferred to the outer housing by means of retaining nut 15. Lower thrust bearing 14 thus helps to facilitate axial rotation of gear mandrel 4 within the housing. Radial loading of the gear mandrel within the outer housing is accommodated by a bushing 16 situated between the gear mandrel and the interior surface of the outer housing. In applications where there is significant radial loading of the gear mandrel (for example in a slant well) bushing 16 may be replaced with a radial bearing.

Figure 3:
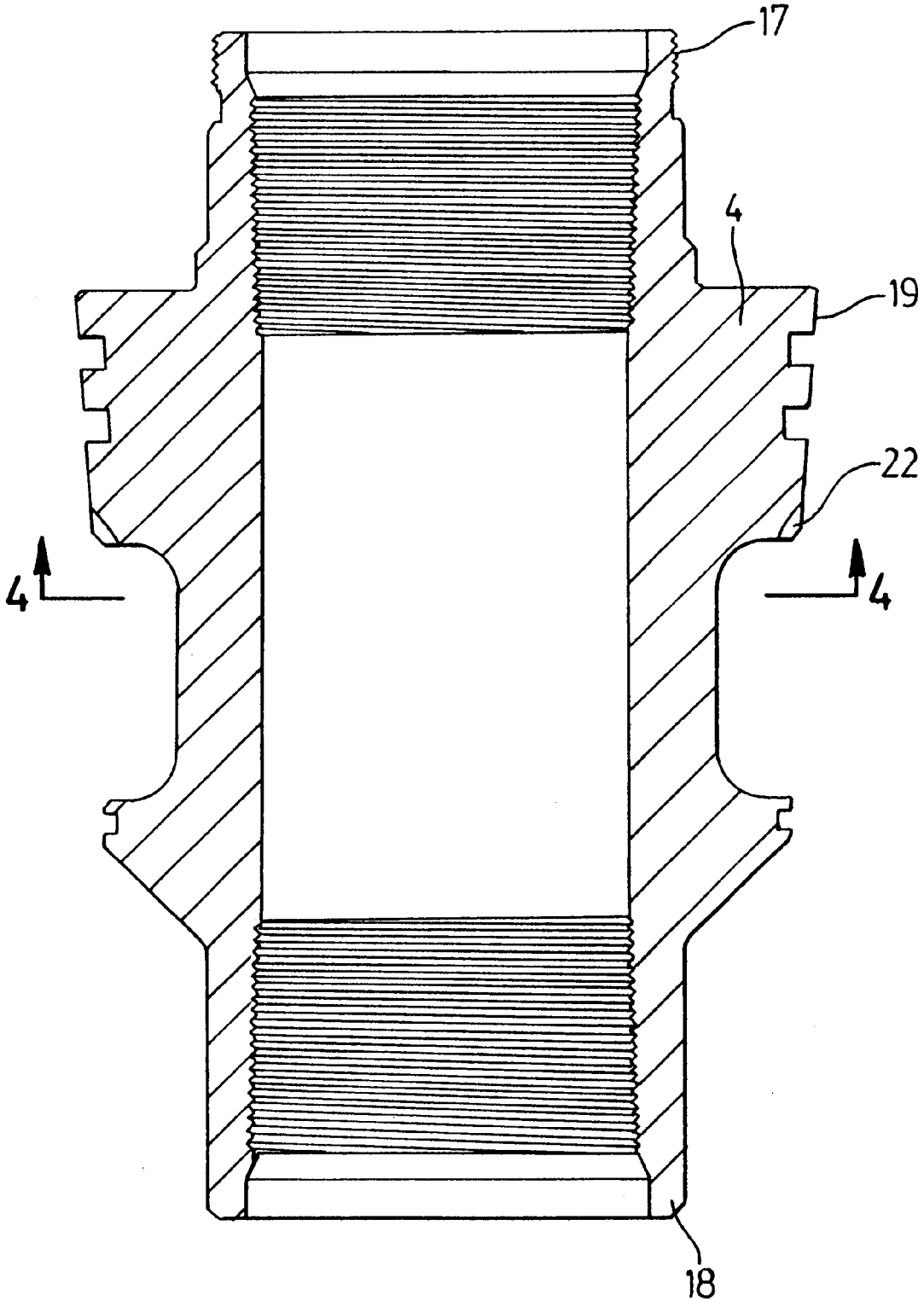
FIG. 3 is a longitudinal sectional view of the tubing string hanger shown in FIG. 1.
Figure 4:
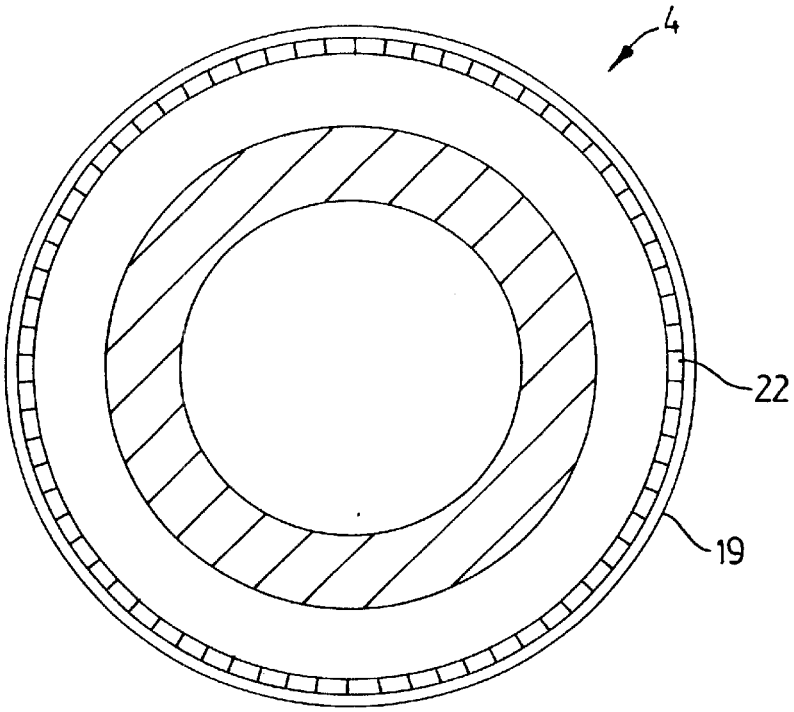
FIG. 4 is a sectional view taken along the line 4—4 of FIG. 3.

Referring next to FIGS. 1, 3 and 4, in a preferred embodiment of the present invention tubing string hanger 4 is comprised of a generally tubular element having an upper end 17, a lower end 18 (to which a tubing string may be attached), and an external surface 19. The exterior surface 19 of tubing string hanger 4 is dimensioned such that the tubing string hanger may be received within bore 11 of gear mandrel 3. Bore 11 may be tapered from upper end 9 to lower end 10 with the external surface of tubing string hanger 4 having a similar taper from its upper to its lower end. When the tubing string hanger is received within the internal bore extending through the gear mandrel, the tapered portion of external surface 19 engages the tapered portion of bore 11 through gear mandrel 3. Since the two respective parts are generally concentric the tapered nature of the exterior of the tubing string hanger and the interior surface of the bore through the gear mandrel helps to maintain them in a concentric configuration.

The contact of the exterior surface of the tubing string hanger with the internal surface of the gear mandrel also assists in providing a seal between the tubing string hanger and the gear mandrel to prevent the escape of fluids and other debris from the well. A series of seals 20 may be integrated into the exterior surface of the tubing string hanger (or the interior surface of the gear mandrel) in order to further help prevent the escape of fluids from between the hanger and the gear mandrel. Additional seals 21 are preferably positioned between gear mandrel 3 and outer housing 2, between gear mandrel 3 and retaining nut 15, and between retaining nut 15 and housing 2, in order to maintain full control of all well fluids. The seals positioned between the gear mandrel and the housing and between the gear mandrel and the lower retaining nut also help prevent the ingress of fluid and debris into the chamber within housing 2 that contains thrust bearing 14 and drive gear 5.

Figure 5:
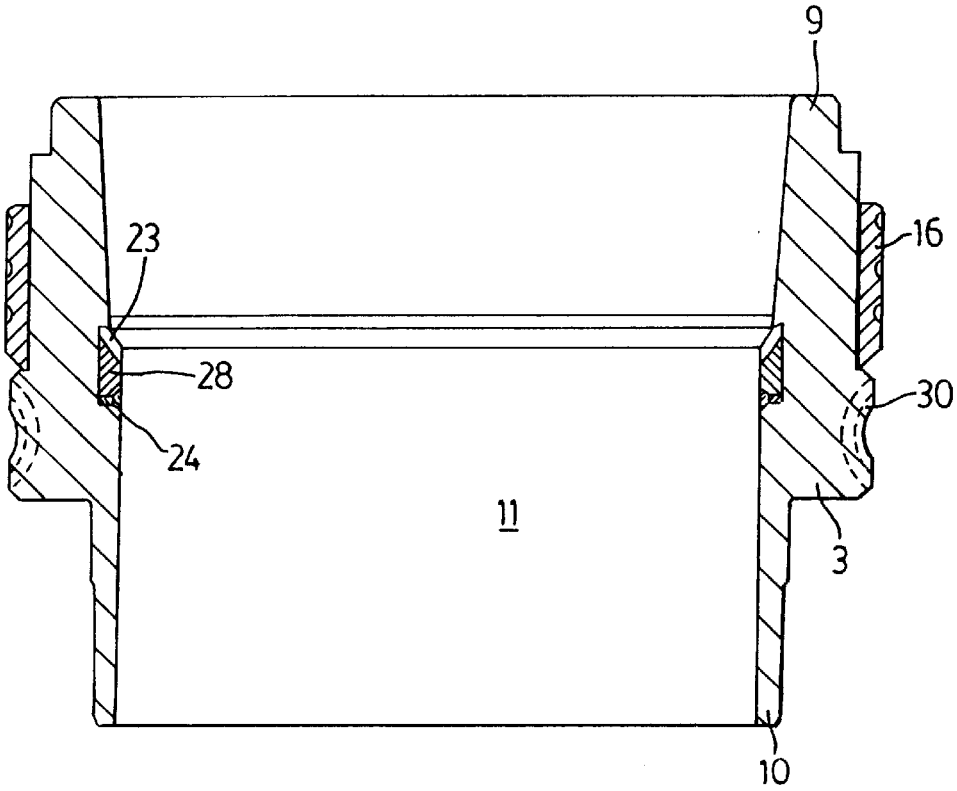
FIG. 5 is a longitudinal sectional view of the gear mandrel of the tubing string rotator shown in FIG. 2.
Figure 6:
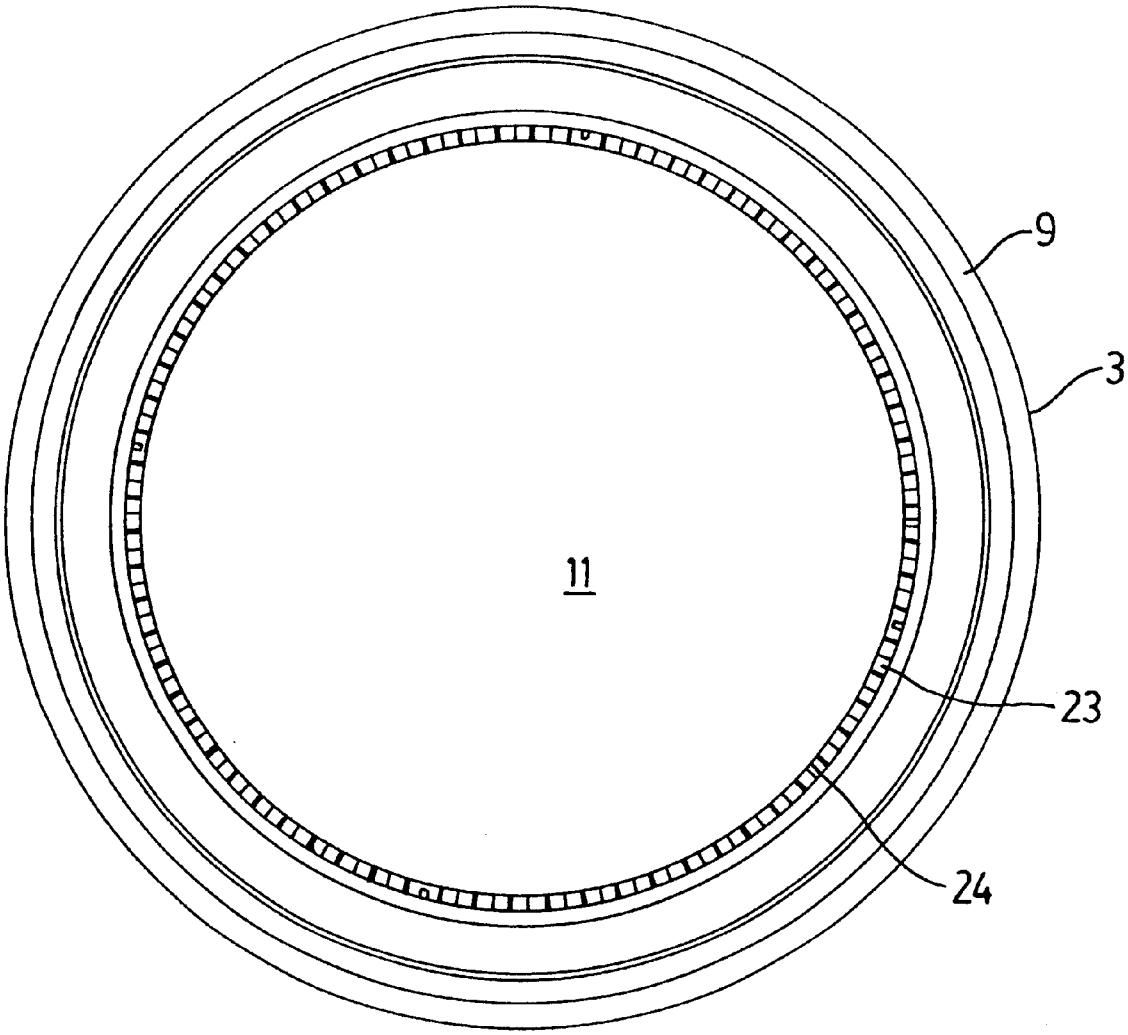
FIG. 6 is a top plan view of the gear mandrel shown in FIG. 5.
Figure 7:
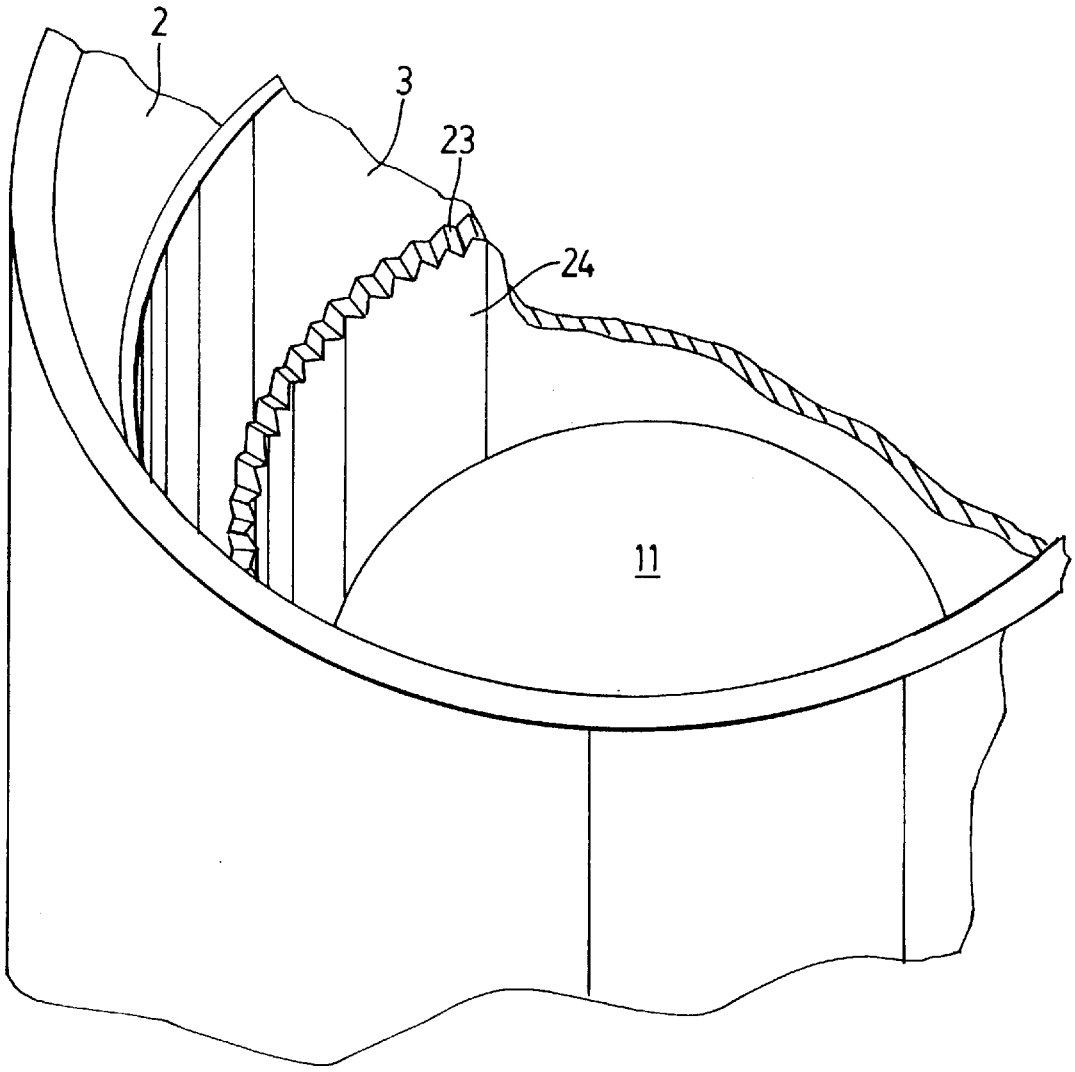
FIG. 7 is a partial upper side perspective cut away view of the outer housing and gear mandrel of one embodiment of the present invention detailing a portion of the interior structure of the gear mandrel.

With general reference to FIGS. 1, 3, 4, 5 and 6, the mechanism by which rotational movement is transmitted from gear mandrel 3 to tubing string hanger 4 will now be described in greater detail. In the preferred embodiment of the invention the external surface 19 of tubing string hanger 4 contains a series of circumferentially positioned, generally downwardly oriented, teeth 22. Similarly, the internal surface of bore 11 extending through gear mandrel 3 also contains a series of circumferentially positioned teeth 23 that are oriented in a generally upward direction. When the tubing string hanger is received and suspended within the internal bore extending through the gear mandrel, teeth 22 on tubing string hanger 4 engage teeth 23 on gear mandrel 3. To accommodate the engagement of teeth 22 and teeth 23, both sets of teeth are preferably of a generally triangular or pyramidal shape and are generally of the same approximate size. In this way the apex of the teeth on the tubing string hanger may be received within the valleys between adjacent teeth on the gear mandrel, and vice-versa. As indicated in FIGS. 5 and 6, in a preferred embodiment of the invention the internal surface of bore 11 preferably includes a reduced diameter portion 24 upon which teeth 23 are positioned. For construction purposes teeth 23 may be formed upon a ring member 28 that is received within bore 11 about reduced diameter portion 24. In addition, while teeth 22 and 23 are constructed such that teeth 22 are generally downwardly directed and teeth 23 generally upwardly directed, as shown in FIGS. 3 and 5, teeth 22 and 23 may also be slightly inclined in order to make them self-cleaning in the event that sand or other debris should become lodged between individual teeth.

Once tubing string hanger 4 is received in gear mandrel 3 with teeth 22 engaged with teeth 23 rotational force applied to the gear mandrel will be at least partially transferred to the tubing string hanger through the engagement of the teeth, causing the tubing string hanger to rotate with the gear mandrel. Teeth 22 and 23 are preferably dimensioned such that at least a portion of the weight of the tubing string hanger is transmitted to and borne by the gear mandrel through the engagement of teeth 22 and 23. The transmission of at least a portion of the load of the tubing string hanger to the gear mandrel through their engaged teeth helps to prevent the tapered hanger from being drawn downwardly into the tapered bore through the gear mandrel to such an extent that it becomes jammed within the gear mandrel, making it extremely difficult to retract or remove the hanger and the string from the well.

The generally triangular or pyramidal shape of teeth 22 and 23 present a mechanism by which tubing string hanger 4 is essentially self-aligning with gear mandrel 3. That is, unlike existing tubing string rotators that utilize spline drives or keys requiring precise alignment, tubing string hanger 4 may be simply lowered into gear mandrel 3 with little concern over alignment. As teeth 22 (and 23 approach one another and come into initial contact they will force the hanger and/or the gear mandrel to rotate to allow the teeth to mesh together. The nature and configuration of teeth 22 and 23 also enhance the ability to insert the tubing string hanger into the gear mandrel where there may be sand or debris built up inside the gear mandrel. Teeth 22 and 23 will tend to drive any debris out from between them as they engage one another and mesh together. In a similar manner, when operating in wells having a high sand content teeth 22 and 23 tend to prevent the tubing string hanger from becoming jammed or locked in place within the gear mandrel in the event that sand or other debris becomes built up between the hanger and the gear mandrel.

In order to retain tubing string hanger 4 within gear mandrel 3, and to ensure that teeth 22 remain engaged with teeth 23 during operation, rotator 1 includes at least two (and preferably three or more) hold down screws 25 that bear against an upper retaining housing 26 that is received within outer housing 2 about upper end 17 of tubing string hanger 4. Preferably a second thrust bearing 27 is positioned between tubing string hanger 4 and upper retaining housing 26 to accommodate upwardly directed loads that may be borne by the tubing string hanger, and to transfer such loads to outer housing 2 through retaining housing 26 and hold down screws 25. A top nut 29 is threaded onto the upper end 9 of hanger 4 to help hold upper retaining housing in place.

It will thus be appreciated from a thorough understanding of the above described structure that tubing string rotator presents a mechanism by which a tubing string hanger may be easily inserted or withdrawn from a rotator with little concern over either the alignment of the hanger within the rotator or with causing damage to the drive mechanism due to misalignment. The described structure provides a mechanical linkage between the gear mandrel within the rotator and the tubing string hanger that not only alleviates alignment problems, but that also facilities the insertion and retraction of the tubing string hanger in situations where debris may be present within the gear mandrel. The tapered connection between at least a portion of the tubing string hanger and the gear mandrel helps maintain the parts in a concentric orientation and enhances the seal between them. At the same time the engagement of the respective teeth on the hanger and the gear mandrel, and the accommodation of at least a portion of the vertical load by those teeth, helps to ensure that the weight of the tubing string does not draw the hanger into the well to such a degree that the hanger becomes jammed within the rotator. In slant well applications, or where the well casing is not perfectly vertical, a portion of the exterior surface of the lower end of the tubing string hanger may contact the internal surface of the lower end of the bore extending through the gear mandrel to further help maintain the concentric alignment of the hanger within both the gear mandrel and the rotator.

It is to be understood that what has been described are the preferred embodiments of the invention and that it may be possible to make variations to these embodiments while staying within the broad scope of the invention. Some of these variations have been discussed while others will be readily apparent to those skilled in the art.

I claim:

1. A tubing string rotator comprising:

(i) an outer housing having an upper end and a lower end with an internal bore extending therethrough from said upper to said lower end;

(ii) a gear mandrel receivable and supportable within said internal bore of said outer housing, said gear mandrel having an upper end and a lower end and an internal surface that defines an internal bore extending through said gear mandrel from said upper to said lower end; and, (iii) a tubing string hanger having an upper end, a lower end and an external surface, said external surface of said tubing string hanger having a series of circumferentially positioned generally downwardly oriented teeth, said tubing string hanger receivable and suspendable within said internal bore extending through said gear mandrel such that said teeth on said tubing string hanger engage a series of generally upwardly oriented teeth circumferentially positioned about said internal surface of said gear mandrel whereby rotational force applied to said gear mandrel is at least partially transferred to said tubing string hanger through engagement of said generally upwardly and said generally downwardly oriented teeth causing said tubing string hanger to rotate with said gear mandrel.

2. The device as claimed in claim 1 including a drive gear, said drive gear engaging said gear mandrel such that rotation of said drive gear causes rotation of said gear mandrel about an axis generally parallel to said internal bore extending through said gear mandrel.

3. The device as claimed in claim 1 wherein at least a portion of the weight of said tubing string hanger is transmitted to and borne by said gear mandrel through the engagement of said generally downwardly oriented teeth on said tubing string hanger with said generally upwardly oriented teeth on said internal surface of said gear mandrel when said tubing string hanger is suspended within said internal bore extending through said gear mandrel.

4. The device as claimed in claim 1 wherein at least a portion of the circumference of said exterior surface of said tubing string hanger, when said hanger is received and suspended within said internal bore extending through said gear mandrel, is in contact with said internal surface of said gear mandrel and assists in providing a seal between said tubing string hanger and said gear mandrel.

5. The device as claimed in claim 1 wherein said internal surface of said gear mandrel is tapered from said upper end to said lower end of said gear mandrel and at least a portion of said exterior surface of said tubing string hanger is tapered from said upper end to said lower end of said tubing string hanger such that when said tubing string hanger is received within said internal bore extending through said gear mandrel said tapered portion of said exterior surface of said tubing string hanger engages said tapered portion of said interior surface of said gear mandrel.

6. The device as claimed in claim 1 including seals positioned between said tubing string hanger and said gear mandrel and between said gear mandrel and said outer housing, said seals assisting in the prevention of the flow of fluid between said tubing string hanger and said gear mandrel, and between said gear mandrel and said outer housing.

7. The device as claimed in claim 1 including a thrust bearing, said gear mandrel engaging said thrust bearing such that downwardly directed vertically oriented load applied to said gear mandrel is carried by said thrust bearing.

8. The device as claimed in claim 1 wherein said generally downwardly oriented teeth on said tubing string hanger and said generally upwardly oriented teeth positioned circumferentially about said internal surface of said gear mandrel are generally pyramidal in shape.

9. The device as claimed in claim 1 wherein said generally downwardly oriented teeth on said tubing string hanger and said generally upwardly oriented teeth positioned about said internal surface of said gear mandrel are generally triangular in shape.

10. The device as claimed in claim 1 wherein said tubing string hanger and said gear mandrel are generally concentric and at least a portion of said exterior surface of said lower end of said tubing string hanger contacts said internal surface of said lower end of said gear mandrel when said tubing string hanger is received within said gear mandrel, said contact of said portion of said exterior surface of said lower end tubing string hanger with said internal surface of said lower end of said gear mandrel assisting in maintaining the concentric alignment of said tubing string hanger with said gear mandrel when said tubing string rotor in a non-vertical orientation.

11. A tubing string rotator comprising:

(i) an outer housing having a generally hollow interior and having an internal bore extending through said housing from an upper end to a lower end of said housing;

(ii) a gear mandrel receivable within said hollow interior of said outer housing, said gear mandrel having an upper end and a lower end and an internal surface that defines an internal bore extending through said gear mandrel from said upper to said lower end;

(iii) a drive gear engaging said gear mandrel such that rotation of said drive gear causes rotation of said gear mandrel about an axis generally parallel to said internal bore extending through said gear mandrel; and, (iv) a tubing string hanger receivable and suspendable within said internal bore of said gear mandrel, said tubing string hanger having an external surface having mounted thereon a plurality of circumferentially positioned generally downwardly oriented teeth, said generally downwardly oriented teeth engaging a plurality of compatibly shaped generally upwardly oriented teeth circumferentially positioned about said internal surface of said gear mandrel when said tubing string hanger is received within said gear mandrel such that said tubing string hanger may be rotated through the transference of rotational force applied to said gear mandrel to said tubing string hanger through engagement of said generally upwardly and said generally downwardly oriented teeth.

12. The device as claimed in claim 11 wherein at least a portion of the weight of said tubing string hanger is transmitted to and borne by said gear mandrel through engagement of said generally downwardly oriented teeth on said tubing string hanger with said generally upwardly oriented teeth on said internal surface of said gear mandrel when said tubing string hanger is suspended within said internal bore extending through said gear mandrel.

13. The device as claimed in claim 12 wherein at least a portion of the circumference of said external surface of said tubing string hanger, when said tubing string hanger is received and suspended within said internal bore extending through said gear mandrel, is in contact with said internal surface of said gear mandrel and assists in providing a seal between said tubing string hanger and said gear mandrel.

14. The device as claimed in claim 11 including a first thrust bearing, said gear mandrel engaging said first thrust bearing such that downwardly directed vertical load applied to said gear mandrel is carried by said first thrust bearing.

15. The device as claimed in claim 14 including a second thrust bearing such that upwardly directed loads borne by said tubing string hanger may be transferred to said outer housing through said second thrust bearing.

16. The device as claimed in claim 15 including at least two hold down screws, when said tubing string hanger received within said internal bore of said gear mandrel, said hold down screws maintaining said tubing string hanger in position within said internal bore and maintaining said generally upwardly oriented teeth on said gear mandrel in engagement with said generally downwardly oriented teeth on said tubing string hanger.

17. A tubing string rotator comprising:

(i) an outer housing having an upper end and a lower end, said lower end adapted to be received upon an oil well casing or wellhead, said outer housing having an internal bore extending therethrough from said upper end to said lower end;

(ii) a gear mandrel received and supported within said internal bore of said outer housing, said gear mandrel having an internal surface that defines an internal bore extending therethrough, said internal surface of said gear mandrel including a reduced diameter portion having circumferentially positioned thereabout a plurality of generally upwardly oriented teeth; and, (iii) a tubing string hanger receivable and suspendable within said internal bore through said gear mandrel, said tubing string hanger having an exterior surface containing a plurality of circumferentially positioned generally downwardly oriented teeth engagable with said generally upwardly oriented teeth of said gear mandrel when said tubing string hanger is received within said internal bore in said gear mandrel such that rotational force applied to said gear mandrel is at least partially transferred to said tubing string hanger through engagement of said generally upwardly and said generally downwardly oriented teeth causing said tubing string hanger to rotate with said gear mandrel, and wherein at least a portion of the weight of said tubing string hanger is transmitted to and borne by said gear mandrel through engagement of said generally upwardly and said generally downwardly oriented teeth.

18. The device as claimed in claim 17 including a first thrust bearing and a second thrust bearing, said gear mandrel engaging said first thrust bearing such that downwardly directed vertically oriented load applied to said gear mandrel is transferred to said outer housing through said first thrust bearing, said tubing string hanger engaging said second thrust bearing such that upwardly directed vertically oriented load applied to said tubing string hanger is transferred to said outer housing through said second thrust bearing.

* * * * *